United States Patent [19]

Krause

[11] Patent Number: 4,462,614

[45] Date of Patent: Jul. 31, 1984

[54] PAGE MARKER

[76] Inventor: Edward Krause, 90 Upton St., Quincy, Mass. 02169

[21] Appl. No.: 373,966

[22] Filed: May 3, 1982

[51] Int. Cl.[3] ..... B42D 9/00

[52] U.S. Cl. ..... 281/42; 281/45; 402/9

[58] Field of Search ..... 281/42, 45, 48; 402/9

[56] References Cited

FOREIGN PATENT DOCUMENTS 16682 of 1892 United Kingdom ..... 281/42
6537 of 1895 United Kingdom ..... 281/42
19700 of 1903 United Kingdom ..... 281/42
2055691 3/1981 United Kingdom ..... 281/42

*Primary Examiner*—Paul A. Bell
*Attorney, Agent, or Firm*—Cesari and McKenna

[57] ABSTRACT

A book marker is formed of an elongated relatively stiff member. Clips or hooks are formed at the opposite ends of the member and an elastic segment is provided along the length of the member so that the book marker ends can be engaged around opposite edges of a book page with the elastic segment retracting said ends toward one another so as to positively clamp the book marker to the book page.

11 Claims, 8 Drawing Figures

PAGE MARKER

This invention relates to page markers. It relates especially to markers of the type which can be used to hold the pages of books, especially the smaller type booklets, such as those sold in bookstores, variety stores and supermarkets.

BACKGROUND OF THE INVENTION

There are myriad different types of book and page markers which are adapted to retain the reader's place in the book. Such markers run the gamut from plain sticks and ribbons to more complicated telescoping markers whose length may be varied depending upon the dimensions of the page to be marked. Examples of such extensible page markers are disclosed in U.S. Pat. Nos. 1,687,438; 1,872,807 and 2,108,492. These prior markers invariably are composed of two sections which are telescopically connected together. Sometimes the remote ends of the two sections are turned over on themselves to form clips which engage the opposite edges of the page to be marked. The two sections can thus be extended or retracted to accommodate the marker to different size books.

However, these prior markers are usually composed of several parts which must be manufactured separately and assembled. Therefore, they are relatively expensive, considering their ultimate use. Also the prior markers tend to be rather bulky so that they are not particularly suitable for marking the pages of relatively small booklets that are usually sold from wire racks at the checkout counters of supermarkets and the like.

SUMMARY OF THE INVENTION

Accordingly, the present invention aims to provide an improved page marker for books and booklets.

Another object of the invention is to provide a page marker which is relatively easy and inexpensive to manufacture.

A further object of the invention is to provide a page marker which can be accommodated to a variety of different size pages.

Still another object of the invention is to provide a marker of this type which does not tend to fall from the book being marked and become lost.

Another object of the invention is to provide a page marker which is easily installed even by handicapped persons.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, in its primary form, the present book marker comprises a thin strip of a suitable relatively stiff, impact-resistant material. The opposite ends of the strip are formed into clips for engaging around the opposite edges of a book page or pages. The strip is formed intermediate its ends with an integral elastic segment which permits the strip to be stretched to some extent to accommodate different length pages to be marked.

The elastic segment of the marker is formed conveniently by providing one or more slit labyrinths in the strip which leave an irregular connection across the entire width of the strip, yet which enable the otherwise stiff strip to be stretched to a significant extent. The elastic segment may assume a variety of different configurations that will be described later.

Instead of comprising a single strip and integral elastic segment, the book marker may comprise a pair of lengthwise strip sections connected by way of an elastic member such that the two sections extend and retract, yet remain aligned. Also, the various book marker embodiments may be provided with a slider clip at one end to permit the marker to engage book pages having a wide variety of different lengths.

Yet, with all of these advantages, the marker can be formed easily from relatively inexpensive materials so that its overall cost is quite low, indeed low enough that the marker can even be given away as a novelty item by banks, stores and other such businesses.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
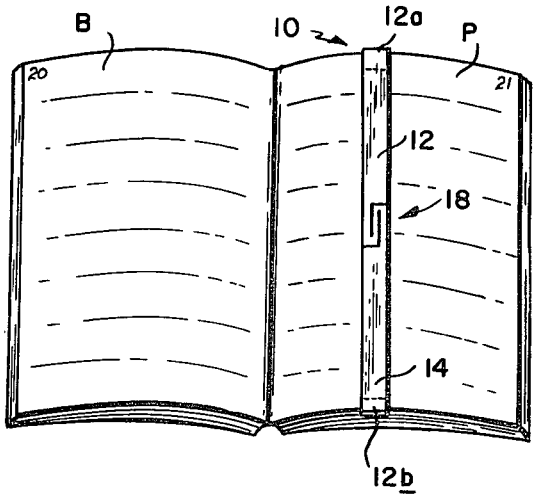
FIG. 1 is a perspective view of a booklet incorporating a page marker made in accordance with this invention.

Referring to FIG. 1 of the drawings, a small booklet B such as the one sold under the name TV GUIDE is shown in its open position at page P containing the present day's TV listings. In order to mark that page, a page marker made in accordance with this invention and indicated generally at 10 is engaged to page P of the booklet.

The marker 10 comprises an elongated strip 12 having opposite ends 12*a* and 12*b* formed as hooks or clips. Strip 12 can be molded of any suitable relatively stiff impact resistant plastic such as polyvinylchloride. Alternatively, it can be made of metal strapping.

Formed integrally in strip 12 intermediate its ends 12*a* and 12*b* is an elastic segment shown generally at 18. Segment 18 permits the strip to be extended elastically to some extent. The length of strip 12 is selected so that it is the same length as page P or slightly less than that length. The marker is engaged to the booklet by stretching strip 12 and engaging the clip ends 12*a* and 12*b* around the upper and lower edges of the page P and the underlying pages. The resiliency of the segment 18 causes the strap to contract lengthwise so that the clip ends engage and clamp the page edges without wrinkling the pages. Therefore, there is no tendency for the page marker to disengage from the booklet even if the booklet should be dropped or handled roughly. Thus the marker always resides at the correct location in the book to mark the desired page.

Figure 2:
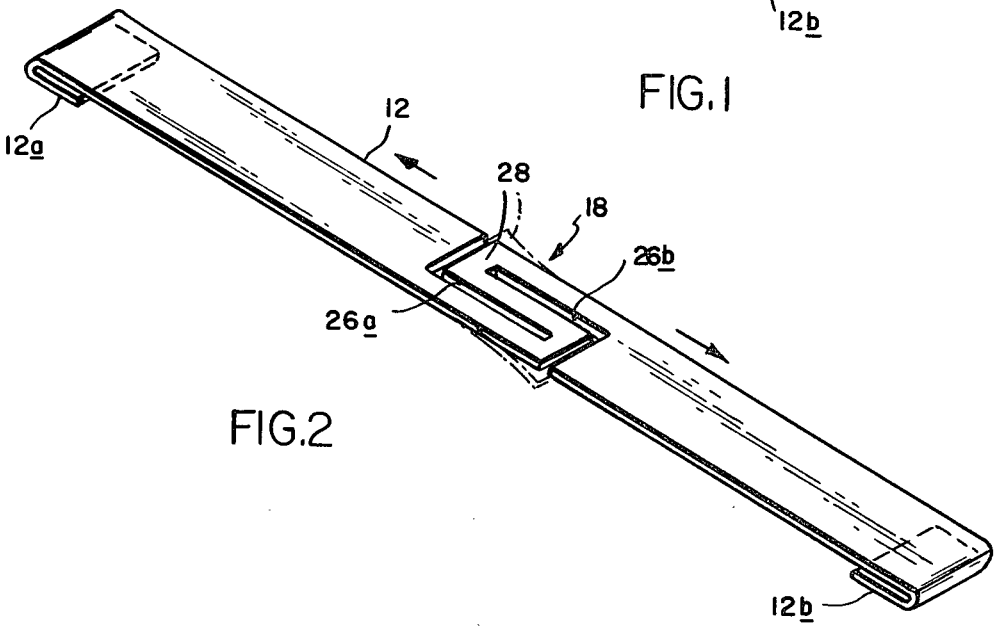
FIG. 2 is a perspective view on a larger scale showing the marker in greater detail.

Turning now to FIG. 2, the elastic segment 18 of the book marker is formed by providing a pair of similar overlapping generally L-shaped slits 26*a* and 26*b* near the middle of the strip. The short leg of the slit 26*a* extends from the right-hand edge of the strip beyond the middle thereof and then extends from that point for a distance along the length of the strip. The slit 26*b* on the other hand extends from the left-hand edge of strip 12 to a point beyond the end of the long leg of slit 26*a* and then lengthwise along strip 12 toward the short leg of slit 26*a*.

Thus the two slits provide a sinuous connection 28 between the opposite edges of strip 12. That connection is relatively narrow and is flexible and resilient so that, when the clip ends 12*a* and 12*b* are pulled apart, the connection 28 deflects out of the general plane of the book marker as shown in dotted lines in FIG. 2. The natural resiliency of that connection 28 tends to cause the strip 12 to contract lengthwise until the connection 28 resumes its unstressed position shown in solid lines in FIG. 2.

Depending upon the dimensions of the slits 26*a* and 26*b*, the segment 18 can enable the strip 12 to be extended on the order of one inch or more without the connection 28 projecting out unduly from the general plane of the strip 1 so as to interfere with the proper closing of the booklet B.

Figure 3A:
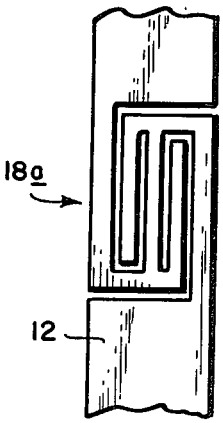
FIGS. 3A to 3C are fragmentary plan views of different marker embodiments.
Figure 3B:
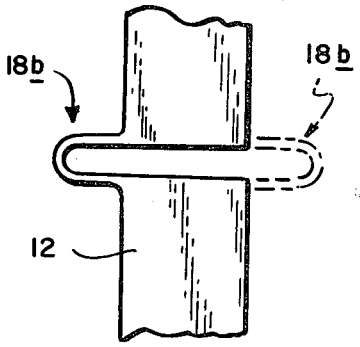
Figure 3C:
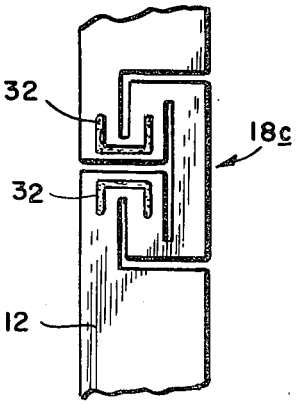

The elastic segment 18 of the book marker can assume a variety of different configurations by appropriately slitting strip 12. FIGS. 3A to 3C illustrate some of these. In FIG. 3A, the elastic segment 18*a* is similar to segment 18 except that a second leg is formed in each slit which renders the strip 12 even more extensible than the FIG. 2 version.

In FIG. 3B, an elastic segment 18*b* is shown which is essentially an integral U-shaped clip connecting opposite end section of the strip 12. If desired, a second such segment shown in dotted lines at 18*b* may be provided to add more resilience and strength to the book marker.

FIG. 3C illustrates still another elastic segment 18*c* formed by a pair of L-shaped slits extending in from the right-hand edge of strip 12 at spaced-apart locations therealong which bracket a generally T-shaped slit extending in from the left-hand edge of strip 12.

Since certain parts of the elastic segments 18*a* and 18*b* and 18*c* may be subjected to greater stress than others, those parts may be reinforced by adding extra material thickness or ridges to the strip at those locations. Examples of such reinforcing ridges are illustrated at 32 in FIG. 3C. Similar ridges can be provided in elastic segments 18, 18*a* and 18*b* at those locations which are subjected to the greatest stress when the strip 12 is extended. In this way, the book marker can be constructed so as to be able to withstand a large number of extensions and retractions without its elastic segment suffering fatigue distress.

Figure 4:
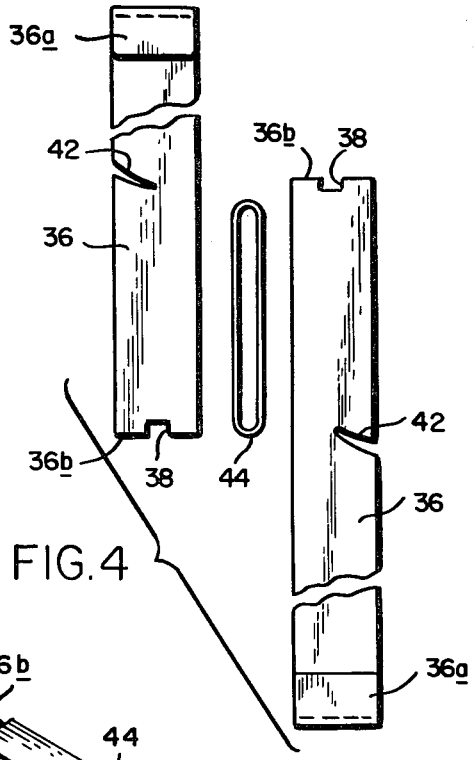
FIG. 4 is an exploded plan view showing still another embodiment of my page marker.
Figure 5:
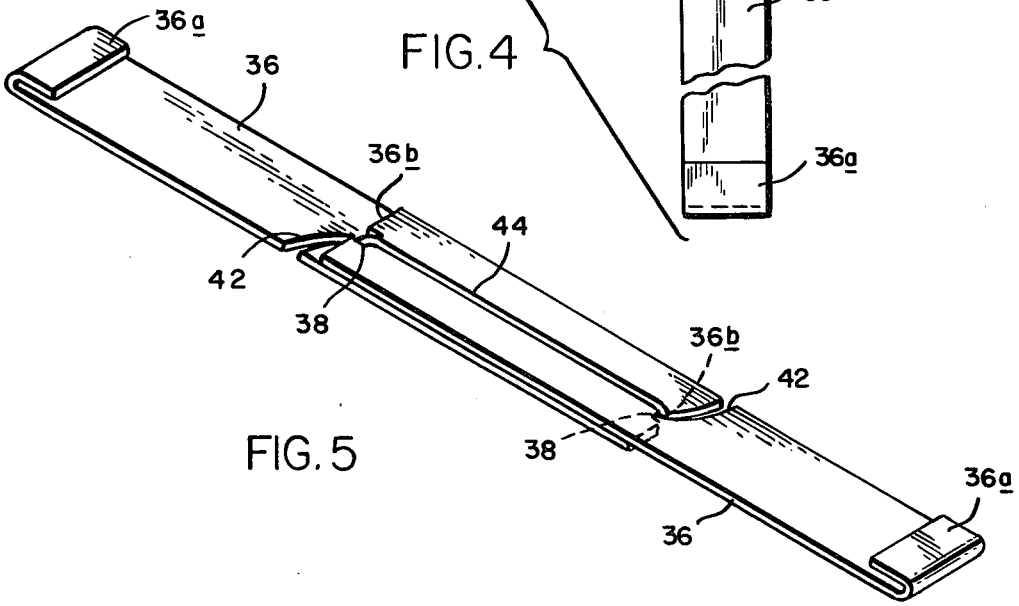
FIG. 5 is a perspective view of the FIG. 4 marker embodiment.

Referring now to FIGS. 4 and 5, this marker embodiment comprises two identical strip sections 36. Each section has one end 36*a* formed as a hook or clip. A small notch 38 is formed in the opposite end of each section. Also each section 36 is stamped or otherwise formed with an oblique slit 42 which extends in from an edge of the section and is angled along the longitudinal axis of the section. Since the two sections 36 are identical, the slits 42 are formed in exactly the same place.

The two sections 36 are superimposed so that their clip ends 36*a* point away from one another and project out in the same direction. When the strip sections are arranged thusly, the slits 42 in the two sections lie on opposite sides of the book marker at axially spaced locations therealong.

The two sections are secured together by an elastic band 44 which is engaged in the slits 42 and so that the band also engages in the notches 38. When the clip ends 36*a* are drawn apart, the elastic band 44 stretches and tends to contract the marker. At the same time, the engagement of the band 44 in the slits and notches maintains the parallel alignment of the two strip sections 36.

This marker can be engaged over and clamped to the upper and lower edges of a book page or pages exactly as described above in connection with the FIG. 2 marker. This version has an advantage over the other embodiments in that it can be extended to a greater degree. It is disadvantaged in respect to them, however, in that it comprises two different parts.

The ability of any of the book marker versions described above to be accommodated to books of different sizes can be extended by making one of the clip ends in the form of a slider on strip 12. Such a slider clip is illustrated at 46 in FIG. 6. The slider 46 is slid onto the end of strip 12 and it is formed with a clip end 46*a* which engages around the booklet pages as described above. A raised boss 48 can be formed in the face of the slider which frictionally engages the strip so that an appreciable amount of force is required to slide the slider along the strip. If desired, stronger retention of the slider at different positions on the strip can be provided by forming a lengthwise series of small openings 52 in the strip in which the slider boss 48 can selectively engage. Of course, any other conventional means may be employed to retard the movement of the slider along the strip.

Figure 6:
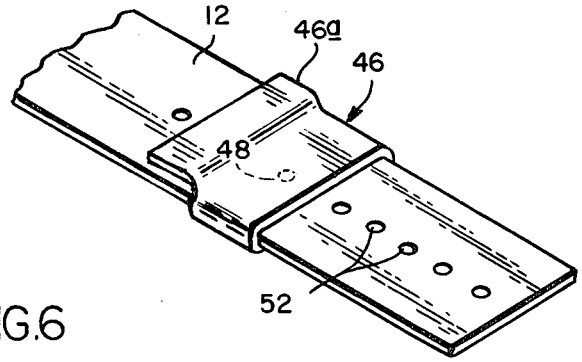
FIG. 6 is a fragmentary perspective view of another book marker variation.

To accommodate the FIG. 6 book marker to a book such as booklet B, the fixed clip end 12*a* is engaged around the upper edge of the page P. Then the opposite end of the marker is engaged to the lower edge of that page by sliding the slider 46 along the strip 12 until its clip end 46*a* engages around the lower edge of the booklet page, while at the same time the marker's elastic segment 18 is stretched to some extent so that a retractive force is exerted on the book marker to clamp it to the book. Then, if desired, the portion of the strap beyond the slider clip 46 can be cut off if the marker is only to be used with that book or a book of a similar or smaller size.

In effect, then, the slider clip provides a gross adjustment of book marker length while the elastic segment provides a fine length adjustment thereof to suit the marker to a particular page or book size. Obviously, a similar slider clip can be incorporated into any of the other marker versions described herein.

Also, while we have specifically illustrated the elastic marker in the form of a flat strap-like article, it could just as well be rod-like, having a diameter that would not interfere with the closing of the booklet to which it is attached.

Thus the book marker disclosed herein can be firmly clamped to different books or booklets having different dimensions. Once attached, the marker will remain there until forceably removed by the reader. Finally, the marker is very simple, and easy and inexpensive to manufacture in quantity. Therefore, it should find wide use by those who read books and booklets.

It will thus be seen that the objects set forth above, among those made apparent from the preceding description, are efficiently attained, and, since certain changes may be made in the above method and in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A book marker comprising

A. a pair of relatively rigid elongated member end sections;

B. means defining a pair of hooks or clips at the remote ends of the end sections; and C. elastic means (1) composed of a plurality of narrow resilient connections formed integrally with said end sections from a single blank of material; and (2) extending between said end sections permitting said sections to be extended resiliently so that the clip or hook-defining means can engage and clamp the opposite edges of a book page.

2. The book marker defined in claim 1 wherein the clip or hook-defining means comprise end portions of the end sections turned over on the end sections.

3. The book marker defined in claim 1 wherein the clip or hook-defining means comprise A. a slider slidably engaged on an end section; and B. a clip or hook end formed integrally with the slider, said clip or hook end being located on the same side of the marker as the other clip or hook-defining means and extending toward said other clip or hook-defining means.

4. The book marker defined in claim 3 and further including means for retarding the movement of the slider along the end section.

5. The book marker defined in claim 4 wherein the retarding means comprise means for increasing the frictional engagement of the slider to the end section.

6. The book marker defined in claim 1 wherein the connection is defined by slits or openings formed in the intermediate sections of said member between said end sections.

7. The book marker defined in claim 1 wherein the member is a flat strip and said slits or openings extend from opposite edges of the intermediate section toward the longitudinal centerline thereof.

8. The book marker defined in claim 1 wherein the slits or openings are overlapped or interleave.

9. A book marker comprising

A. a pair of similar relatively rigid elongated flat strips;

B. means defining a pair of hooks or clips at the remote ends of the strips;

C. a slit extending laterally from an edge of each strip toward the longitudinal centerline thereof;

D. a notch formed in the end of each strip opposite the clip-defining means thereon, said strips being positioned face to face so that they are aligned with their slits lying on opposite sides of the longitudinal centerline of the marker; and E. an elastic band engaged in the slits and notches which resiliently connects the strips and maintains their alignment when the strips are resiliently extended so that the clip or hook-defining means can engage and clamp the opposite edges of a book page.

10. The book marker defined in claim 9 wherein the clip or hook-defining means comprise end portions of said strips turned back on themselves.

11. The book marker defined in claim 9 wherein the clip or hook-defining means comprise A. a slider slidably engaged on a strip; and B. a clip or hook end formed integrally with the slider, said clip or hook end being located on the same side of the marker as the other clip or hook-defining means and extending towards said other clip or hook-defining means.

* * * * *